US009307329B2

(12) United States Patent
Saarimaa et al.

(10) Patent No.: US 9,307,329 B2
(45) Date of Patent: Apr. 5, 2016

(54) CONTROL DEVICE FOR INDUCTION LOOP SYSTEM

(71) Applicant: TELESILMUKKA OY, Kempele (FI)

(72) Inventors: Juha Saarimaa, Oulu (FI); Paavo Niemitalo, Kello (FI)

(73) Assignee: TELESILMUKKA OY, Kempele (FI)

( * ) Notice: Subject to any disclaimer, the term of this patent is extended or adjusted under 35 U.S.C. 154(b) by 0 days.

(21) Appl. No.: 14/588,634

(22) Filed: Jan. 2, 2015

(65) Prior Publication Data

US 2015/0195660 A1 Jul. 9, 2015

(30) Foreign Application Priority Data

Jan. 3, 2014 (FI) ..... 20145004

(51) Int. Cl.

| | |
|---|---|
| ***H04R 25/00*** | (2006.01) |
| ***H01Q 1/27*** | (2006.01) |
| ***H04R 27/02*** | (2006.01) |
| ***H01Q 7/00*** | (2006.01) |

(52) U.S. Cl.

CPC ..... *H04R 25/00* (2013.01); *H01Q 1/273* (2013.01); *H01Q 7/00* (2013.01); *H04R 27/02* (2013.01)

(58) Field of Classification Search

CPC ..... H04R 25/00
USPC ..... 381/312, 331
See application file for complete search history.

(56) References Cited

U.S. PATENT DOCUMENTS

| | | | | |
|---|---|---|---|---|
| 6,307,945 | B1 * | 10/2001 | Hall | 381/315 |
| 2005/0244012 | A1 * | 11/2005 | Asada | 381/56 |
| 2007/0098195 | A1 * | 5/2007 | Holmes | 381/315 |
| 2012/0328116 | A1 * | 12/2012 | Bidmead et al. | 381/59 |
| 2014/0270267 | A1 * | 9/2014 | Cedro | 381/123 |

FOREIGN PATENT DOCUMENTS

| | | |
|---|---|---|
| EP | 2 651 150 | 10/2013 |
| JP | 2003-163999 | 6/2003 |
| WO | WO 89/08970 | 9/1989 |

OTHER PUBLICATIONS

Finnish Office Action issued in Finnish Patent Application No. 20145004 dated Sep. 18, 2014.
Finland Search Report for FI Application 20145004, dated Sep. 18, 2014, 1 page.

* cited by examiner

*Primary Examiner* — Ahmad F Matar
*Assistant Examiner* — Katherine Faley
(74) *Attorney, Agent, or Firm* — Nixon & Vanderhye P.C.

(57) ABSTRACT

There is provided a control device (220) for an induction loop system configured to: generate a calibration signal (202) having a known amplitude and frequency; feed the calibration signal (202) to an induction loop amplifier (106); detect level of electric current at the output of the induction loop amplifier (106); and determine an adjustment model (400) on the basis of the detected level of electric current and the known amplitude and frequency, wherein the adjustment model (400) is for adjusting the amplitude of a to-be-fed output signal (200) based on the frequency of a to-be-received input electrical audio signal (105) such that the level of the electric current at the output of the induction loop amplifier (106) is within predetermined limits.

9 Claims, 5 Drawing Sheets

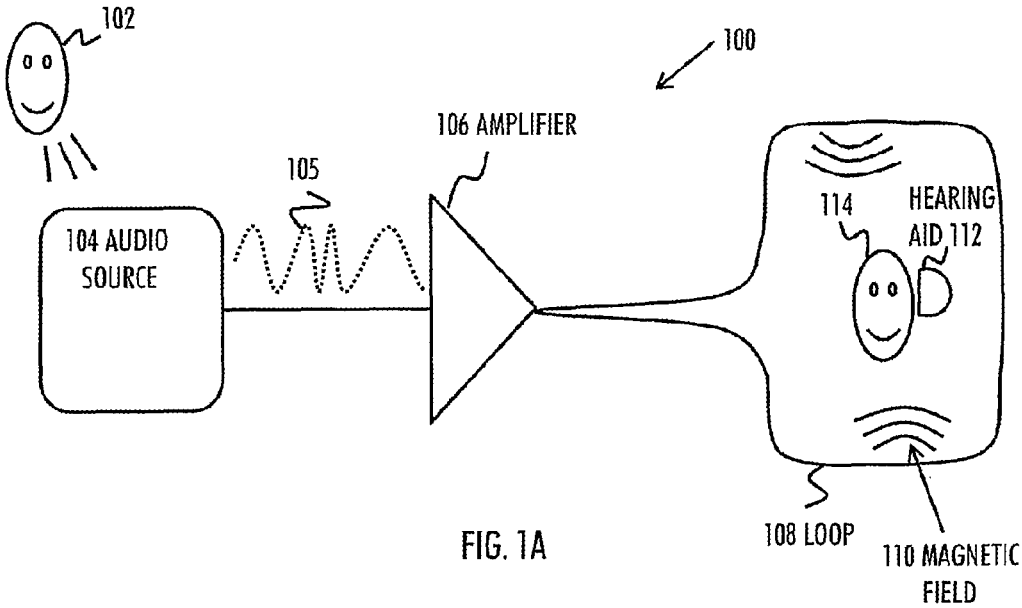
FIG. 1A
| AUDIO SIGNAL FREQUENCY | IMPEDANCE OF LOOP | AMPLITUDE CORRECTION | CURRENT FLOW IN LOOP |
|---|---|---|---|
| F | Z | NO | I |
| F- | Z- | NO | I+ |
| F-- | Z-- | NO | I++ |
| F--- | Z--- | NO | I+++ |
| F---- | Z---- | NO | I++++ |
FIG. 1B
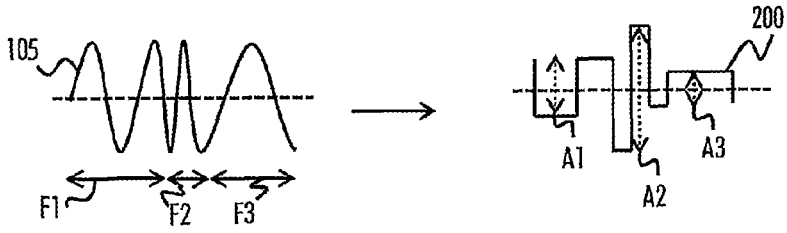
FIG. 2B

CONTROL DEVICE FOR INDUCTION LOOP SYSTEM

This application claims priority to Finnish patent application No. 20145004, filed on Jan. 3, 2014, the entire contents of which is hereby incorporated by reference

FIELD OF THE INVENTION

The invention relates generally to improving hearing experience for hearing-impaired persons, and more particularly to control devices for induction loop systems.

BACKGROUND

Induction loop systems may be used for improving the voice quality for hearing aid devices. Induction loop systems comprise induction loops, which transmit audio signals wirelessly to a person's hearing aid device via electromagnetic fields.

BRIEF DESCRIPTION OF THE INVENTION

According to an aspect of the invention, there is provided a control device as specified in claim 1.

According to an aspect of the invention, there is provided a method for use in an induction loop system, comprising: generating a calibration signal having a known amplitude and frequency, feeding the calibration signal to an induction loop amplifier, detecting level of electric current at the output of the induction loop amplifier, and determining an adjustment model on the basis of the detected level of electric current and the known amplitude and frequency, wherein the adjustment model is for adjusting the amplitude of a to-be-fed output signal based on the frequency of a to-be-received input audio signal such that the level of the electric current at the output of the induction loop amplifier is within predetermined limits.

According to an aspect of the invention, there is provided a computer program product embodied on a distribution medium readable by a computer and comprising program instructions which, when loaded into a control device for an induction loop system, cause the control device to execute at least the following steps: generating a calibration signal having a known amplitude and frequency, feeding the calibration signal to an induction loop amplifier, detecting level of electric current at the output of the induction loop amplifier, and determining an adjustment model on the basis of the detected level of electric current and the known amplitude and frequency, wherein the adjustment model is for adjusting the amplitude of a to-be-fed output signal based on the frequency of a to-be-received input audio signal such that the level of the electric current at the output of the induction loop amplifier is within predetermined limits.

According to an aspect of the invention, there is provided a computer-readable distribution medium carrying the above-mentioned computer program product.

According to an aspect of the invention, there is provided a control device for an induction loop system, comprising input interface means for receiving an input audio signal from an audio source, output interface means for transmitting an output signal to an induction loop amplifier, wherein the induction loop amplifier is configured to feed an induction loop, processing means for generating a calibration signal having a known amplitude and frequency, processing means for feeding the calibration signal to the induction loop amplifier, processing means for detecting level of electric current at the output of the induction loop amplifier, and processing means for determining an adjustment model on the basis of the detected level of electric current and the known amplitude and frequency, wherein the adjustment model is for adjusting the amplitude of a to-be-fed output signal based on the frequency of a to-be-received input audio signal such that the level of the electric current at the output of the induction loop amplifier is within predetermined limits.

According to an aspect of the invention, there is provided an apparatus comprising means for performing any of the embodiments as described in the appended claims.

Embodiments of the invention are defined in the dependent claims.

LIST OF THE DRAWINGS

In the following, the invention will be described in greater detail with reference to the embodiments and the accompanying drawings, in which FIG. 1A presents an example induction loop system;

FIG. 1B presents an example table showing how the current may vary in an induction loop of the induction loop system;

FIG. 2B shows an example on how to convert an input audio signal into digital output signal;

DESCRIPTION OF EMBODIMENTS

Figure 2A:
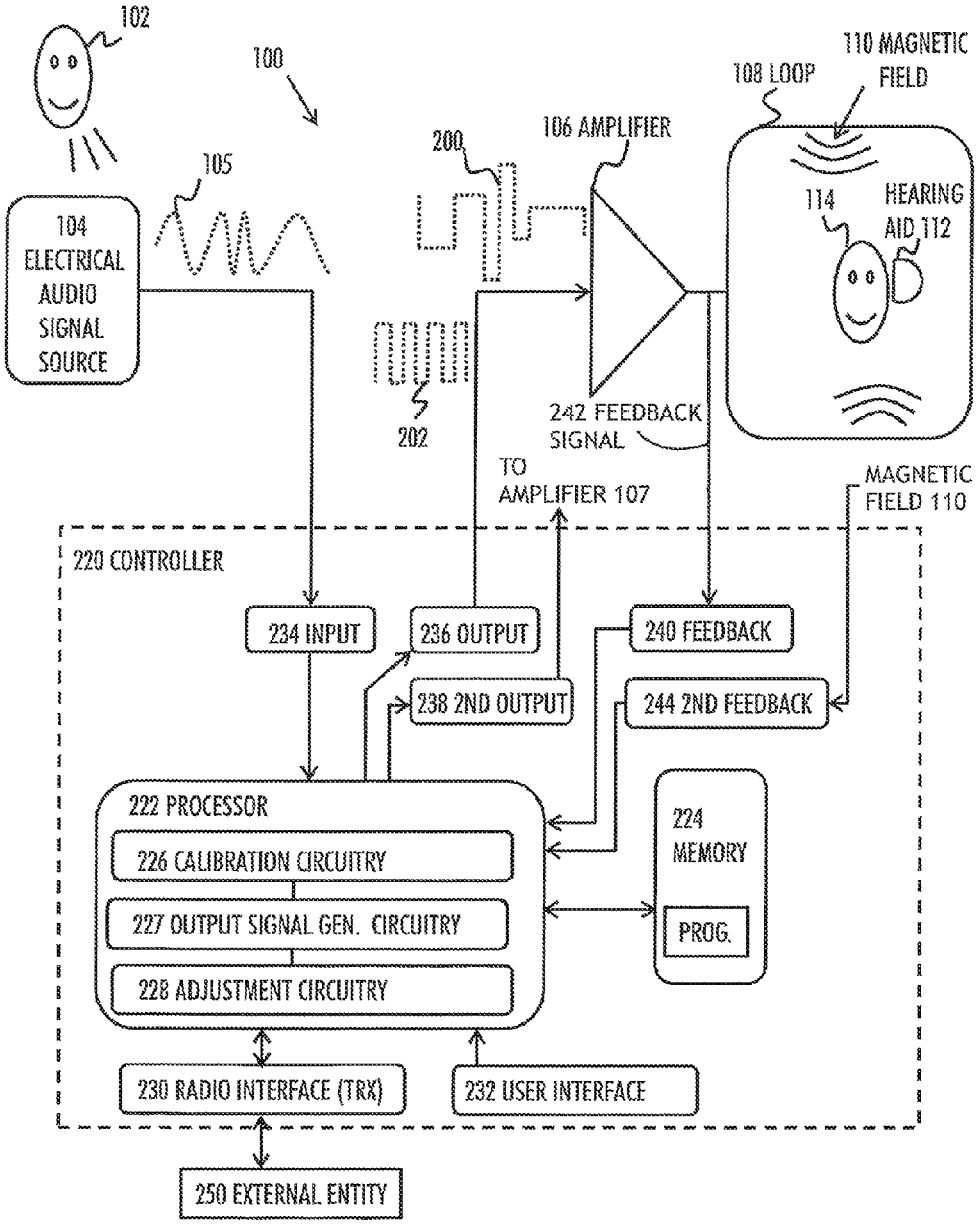
FIG. 2A shows an induction loop system, according to an embodiment.

The following embodiments are exemplary. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

FIG. 1A shows an example induction loop system 100, also known as an audio-frequency loop system (AFIL) or a hearing loop. The system 100 may include an electrical audio signal source 104, such as transducer. One example of the electrical audio signal source 104 may be a microphone to which a speaker 102 speaks to. The audio signal detected by the microphone is converted into electrical audio signal 105 which may be amplified by an induction loop amplifier 106 and then conducted to an induction loop 108. The amplifier 106 thus feeds an output signal to the loop 108. This output signal may generate a flow of electric current in the loop 108, which consequently generates electromagnetic field 110 proportional to the intensity of electric current flowing in the loop 108. The electromagnetic field 110 radiates in space around the loop 108, as shown in FIG. 1A. The induction loop 108 may be a loop of cable around a designated area, such as a room or a building, or a special counter loop located, e.g. underside of a table. Induction loops 108 may be fixed or portable.

The hearing aid (device) 112, which a listener 114 wears in his/her ear, may comprise a coil or another suitable magnetic field receiver. As a result, the wireless electromagnetic field 110 is detectable by the coil in the hearing aid 112. The received wireless magnetic field 110 may generate a flow of current in the coil of the hearing aid 112. Then the hearing aid 112 may to transform this generated current into an output audio signal which may be further amplified and finally output as an acoustic signal to listener's 114 ear.

In an embodiment, one of the reception modes (typically mode "T") of the hearing aid device 112 may determine that the hearing aid device 112 receives the wirelessly transmitted electromagnetic field 110, but not the background noise. The background noise may be cancelled because the microphone of the hearing aid 112 may be inactivated in the reception mode "T", for example. In this way, the background noise is not interfering and does not cause problems to the listening person. In an embodiment, the hearing aid also includes a possibility for a double mode, such as an "MT" mode, in which the microphone of the hearing aid 112 may also be active and detect background audio signals, in addition to the coil of the hearing aid 112 detecting the wireless signal carried by the electromagnetic field 110.

One of the fundamental issues with induction loop systems 100 is that the size of the applied induction loop 108 affects the impedance Z of the loop 108. Further, the impedance Z of the loop 108 is frequency dependent, meaning that an input audio signal with one frequency μl may experience different impedance Z than an input audio signal with another frequency F2. This is shown in more details in FIG. 1B. Input audio signals with lower frequencies F (marked with minus (−) signs) may be associated with lower impedances Z (likewise marked with minus (−) signs), whereas input audio signals with higher frequencies F may be associated with higher impedances Z.

In FIG. 1B, it is assumed that no frequency dependent amplitude correction/adaptation is used. As a result, lower impedances Z−, corresponding to lower frequencies F−, may cause the electric current I flowing in the loop 108 to be higher (indicated with plus (+) signs). Likewise higher impedances Z, corresponding to higher frequencies F, may cause the electric current I flowing in the loop 108 to be lower. As a result, the intensity/level of the electric current I in the loop 108 may not be constant throughout the used frequency range (e.g. from F− to F) and this may cause the volume of the output audio signal heard by the listener 114 to vary. In other words, the frequency response of the output audio signal heard by the listener 114 may vary, which is not desired.

Moreover, there is an International standard, which establishes the intensity of the magnetic field 110 and the frequency response needed from the system 100. The standard specifies that over a range from 100 Hz to 5 kHz, the output level (=volume) of the output audio signals shall be within a predetermined limits of +/−3 dB relative to the signal at 1 kHz. In order to fulfil this requirement, it may be that personnel may need to manually configure the induction loop system 100 or install a frequency response corrector (e.g. an equalizer) to the system 100. This may take place by the personnel measuring the magnetic field strength and manually adjusting an equalizer accordingly. By performing such manual adaptation, the output volume (level) of the output audio signal may be substantially even throughout the frequency range and fulfil the requirements. However, such manual work is time consuming and a cumbersome task.

Therefore, there is provided, as shown in FIG. 2A, a control device (i.e. a controller) 220 for the induction loop system 100. However, unlike in FIG. 1, the input electrical audio signal 105 from the electrical audio signal source 104 is not conveyed directly to the amplifier 106, but to the controller 220, which may perform automatic amplitude adaptation to the input electrical audio signal 105, convert the input electrical audio signal 105 into an output signal 200, and then transfer the output signal 200 to the amplifier 106. As a result, there is no need for manual configuration of the induction loop system 100 in order to satisfy the output level requirement with respect to frequency F. Moreover, there is no need to adapt the induction loop 108 manually to the used amplifier 106. This enables that different loops may be connected to the amplifier 106 without a need for manually performing the frequency response correction.

Let us look at the proposal of FIG. 2A closer. The control device 220 may comprise an input interface 234 for receiving the input electrical audio signal 105 from the electrical audio signal source 104. The interface 234 may be any of the ports used for reception of audio signals, such as a phone connector (also known as audio jack) from a microphone 104, for example. The input electrical audio signal 105 may be conveyed via a wire from the electrical audio signal source 104 or the input electrical audio signal 105 may be received wirelessly from the electrical audio signal source 104.

The controller 220 may further comprise an output interface 236 for transmitting the output signal 200 to the induction loop amplifier 106. The output interface 236 may be capable of conveying digital signals, in case the input electrical audio signal 105 is converted into a digital output signal 200.

In an embodiment, the controller 220 and the amplifier 106 are integrated to one structural entity. Then an amplifying entity of the induction loop system 100 may comprise the controller 220 and the amplifier 106 (and an amplifier 107). In another embodiment, the controller 220 and the amplifier 106 are different structural entities.

The controller 220 may further comprise at least one processor 222 and at least one memory 224 including a computer program code (PROG), wherein the at least one memory 224 and the computer program (PROG) code are configured, with the at least one processor 222, to cause the controller 220 to perform various functions, according to different embodiments. The memory 224 may be implemented using any suitable data storage technology, such as semiconductor based memory devices, flash memory, magnetic memory devices and systems, optical memory devices and systems, fixed memory and removable memory.

Figure 3:
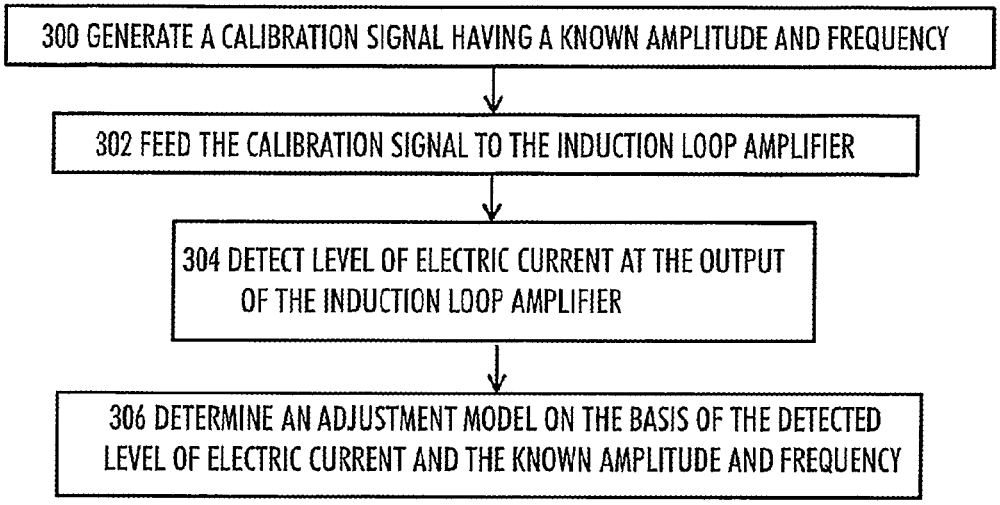
FIGS. 3 and 5 depict methods according to some embodiments.

In order to perform the automatic frequency response correction for the output signal 200 which is to-be-fed to the amplifier 106, the controller 220 may be caused to perform a calibration phase. In step 300, the controller 220 may generate a calibration signal 202 having a known amplitude and frequency, as shown in FIG. 3. The calibration signal 202 may also be called a stimulus, a calibration stimulus, or a test signal. In an embodiment, the calibration 202 signal is in digital form. In an embodiment, the calibration 202 signal is in analog form. In an embodiment, the calibration signal 202 is a multi-tone signal having different frequencies.

In an embodiment, the known frequency of the calibration 202 signal is the maximum frequency of a predetermined frequency range. The predetermined frequency range may be anything. However, in an embodiment, it is from 100 Hz to 5 kHz. In an embodiment, the maximum frequency may correspond to 5 kHz. Signals having the maximum frequency experience highest impedance Z, as shown in FIG. 1B. Therefore, it may be beneficial to perform the calibration or the first calibration step with the highest impedance/resistance Z in order to detect what the maximum attenuation of the current in the loop 108 is.

In an embodiment, the controller 220 may itself generate the calibration signal 202. In such case, any input audio signal need not be received. However, in another embodiment, the controller 220 may first acquire the input audio signal and generate the calibration signal 202 on the basis of the received audio signal. In such case, the input audio signal may be seen as an input calibration audio signal. The received input audio signal may be of predetermined frequency. In an embodiment, this may correspond to the maximum frequency of the predetermined frequency range. The controller may then generate the calibration signal 202 to have the maximum operation frequency and the known amplitude. In yet one embodiment, the calibration signal 202 may be fed to the controller 220 from an external entity 250.

The known amplitude of the calibration signal 202 may in an embodiment correspond to the maximum amplitude allowed by the amplifier 106. In case the controller 220 generates the calibration signal 202 on the basis of the received input audio signal, the controller 220 may apply the frequency of the input audio signal but the controller 220 may adjust the amplitude of the received input amplitude signal to correspond to the maximum amplitude allowed by the amplifier 106, for example.

In an embodiment, in case many calibration signals are applied, the amplitude of each of the calibration signals may remain the same (known). However, the frequency of different calibration signals may be different so as to sweep through the whole frequency range, for example.

Thereafter, the controller 220 may, in step 302, feed the calibration signal 202 to the induction loop amplifier 106. The feed of the calibration signal 202 may be performed via the output interface 236. As said, the used frequency of the signal 202 and the used induction loop 108 may have effect on the electric current flowing in the loop 108, i.e. the electric current flowing at the output of the induction loop amplifier 106. Therefore, in step 304, the controller 220 may detect the level of electric current at the output of the induction loop amplifier 106.

In an embodiment, the controller 220 may further comprise a feedback interface 240. In this case, the controller 220 may detect the level of electric current at the output of the induction loop amplifier 106 by receiving a feedback signal 242 from the output of the induction loop amplifier 106 via the feedback interface 240, as shown in FIG. 2B. This closed-loop type of feedback may be advantageous as then the controller 220 always notices immediately any changes in the electric current at the output of the amplifier 106. In another embodiment, the level of the electric current (e.g. the intensity/level of the electric current in amperes) may be signalled to the controller 220 by using an external measuring device which transmits an indication of the level of electric current to a radio interface 230 of the controller 220 wirelessly, for example. In this embodiment, no feedback interface 240 may be needed.

Figure 4:
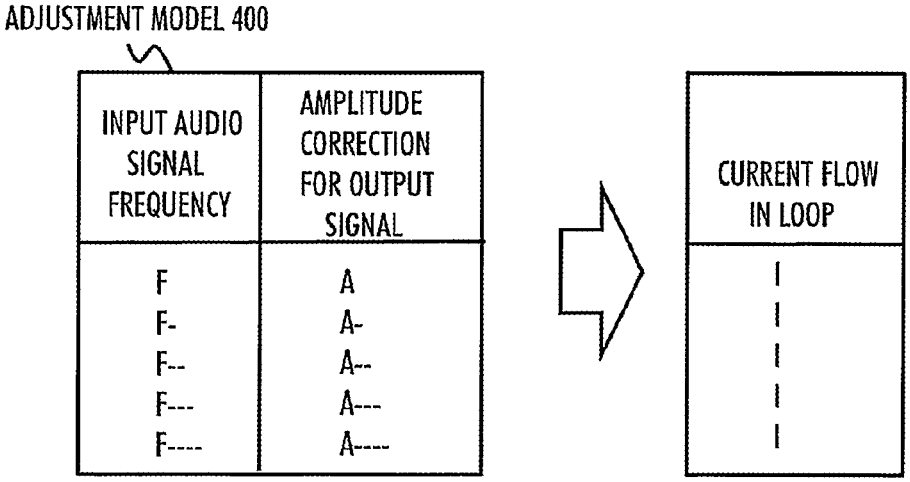
FIG. 4 shows an adjustment model and how it may be used to affect the current flow in the induction loop.

In step 306, the controller 220 may then determine an adjustment model 400 of FIG. 4 on the basis of the detected level of electric current and the known amplitude and frequency. As shown in FIG. 4, the adjustment model 400 may be for adjusting the amplitude of a to-be-fed output signal 200 based on the frequency of a to-be-received input electrical audio signal 105 such that the level of the electric current at the output of the induction loop amplifier 106 (i.e. in the loop 108) is within predetermined limits (marked with at least substantially constant I in FIG. 400). The predetermined limits may define that the level (e.g. volume) of the output analog signal may, regardless of the frequency of the input electrical audio signal 105, vary within +/−3 dB as compared to the level at 1 kHz frequency. Typically this means that the amplitude of the output signal 200 having lower frequencies F need to be decreased compared to the amplitude of the output signal 200 having higher frequencies F. Such amplitude decrease is shown with minus (−) signs after amplitude A. Naturally, increase of the amplitude A is possible, if seen appropriate. This may enable the induction loop system 100 to meet the system standards.

Although depicted with a table-like model, the adjustment model 400 may be an equation, correction/weighting factor, or anything which the controller 220 may use to adjust the amplitude of the output signal 200 depending on the frequency of the received input electrical audio signal 105.

In an embodiment, it is possible to generate the correction model 400 on the basis of one calibration signal 202 (wherein the frequency and amplitude of the calibration signal 202 are known). In order to do this, there may be some prior knowledge of the amplifier characteristics. For example, if it is known that the frequency dependency for the current flow is linear with a known slope, use of only one calibration signal 202 may be enough.

In an embodiment, where the amplifier 106 and the controller 220 are comprised in one single structural entity, the controller 220 may be basically paired with a certain amplifier 106. Then the controller 220 may be preconfigured with information of the frequency response of the paired amplifier 106.

Then, the unknown factor in the frequency response arises from the used induction loop 108 (such as the length, material, etc.). By connecting the loop 108 to the controller-amplifier-entity, the loop 108 generates an unknown load to the system. By performing the automatic frequency response correction as explained, this unknown factor caused by the loop 108 may be taken into account in the generation of the adjustment model 400.

However, in another embodiment, the controller 220 may generate a plurality of calibration signals 202, each having a known amplitude and frequency, wherein at least the frequencies between different calibration signals are different and within a predetermined frequency range. The predetermined frequency range may be, e.g. from 100 Hz to 5 kHz. Consequently, as was the case in FIG. 3, the controller 220 may then feed the calibration signals 202 consecutively to the induction loop amplifier 106 and detect, for each of the calibration signals, the level of electric current at the output of the induction loop amplifier 106. By using these multiple detected electric levels for different frequencies, the controller 220 may determine the adjustment model 400. As a result, the controller 220 becomes aware of the frequency response of the amplifier 106. In other words, the controller 220 uses at least two different frequencies in the calibration signals 202 and thus obtains knowledge of how the amplifier 106 affects to calibration signals 202 having different frequencies.

This option of using plurality calibration signals 202 may ensure that the established adjustment model 400 is accurate over the whole frequency range. Further, no prior knowledge of the amplifier 106 behaviour (e.g. gain for different frequencies) is needed. This may enable the controller 220 to be used with any amplifier 106.

As a result, the controller 220 may have obtained knowledge of the adjustment model 400 for the frequency response correction. The controller 220 may apply the adjustment model 400 during operation of the induction loop system 100.

Figure 5:
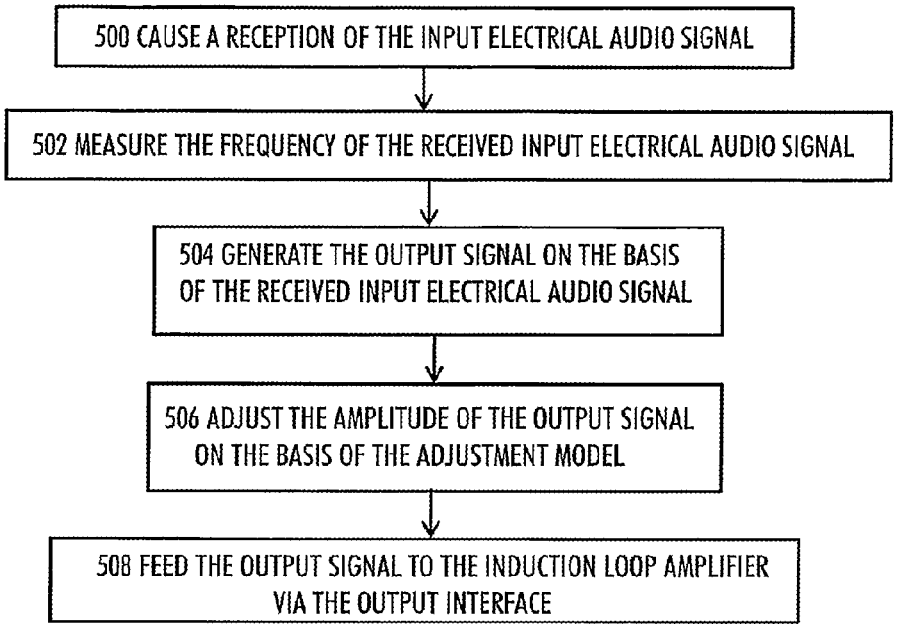

In an embodiment, as shown in FIGS. 2A, 2B, and 5, the controller 220 may in step 500 receive the input electrical audio signal 105. The reception may be via the input interface 234, for example. In step 502, the controller 202 may measure the frequency of the received input electrical audio signal 105. It may be noted that the input electrical audio signal 105, based e.g. on the voice of the speaker 104, may have different frequencies, as is the case in FIGS. 2A and 2B.

In step 504, the controller 220 may generate the output signal 200 on the basis of the received input electrical audio signal 105. For example, the frequency of the inputted electrical audio signal 105 may define the frequency of the output signal 200. In step 506, the controller 220 may then adjust the amplitude of the output signal 200 on the basis of the adjustment model 400 and the measured frequency/-ies.

For example, as shown in FIG. 2B, the controller 220 may detect that there are three different frequencies F1, F2, and F3 in the input electrical audio signal 105. When generating the output signal 200, the controller 220 may keep the frequencies of the output signal 200 the same as in the input electrical audio signal 105. However, in order to provide substantially even frequency response to the listener 114, the controller 220 may advantageously adjust the output signal 200 based on the frequency of the input electrical audio signal 105, and the adjustment model 400. In this example of FIG. 2B, the controller 220 has decreased the amplitude levels A1 and A3 because they correspond to lower frequencies F1 and F3 than the frequency μl (amplitude level A1 corresponds to the frequency level of F1).

It may be noted that the amplitude of the input electrical audio signal 105 may vary as well, depending on the voice detected by the electrical audio signal source 104. However, for the sake of simplicity, such varying is not depicted here. It may be said, however, that the adjustment model 400 may indicate how the amplitude associated with certain frequency needs to be adjusted, regardless of the amplitude level of the input electrical audio signal 105. Further, it may be noted that, for the sake of clarity, the output signal 200 does not depict the sampling used to derive the output signal 200. Thereafter, in step 508, the controller 220 may feed the output signal 200 to the induction loop amplifier 106 via the output interface 236 so that the amplifier 106 may amplify the signal 200 and feed the signal 200 to the loop 108.

In an embodiment, the controller 220 may perform an analog-todigital conversion to the received analog electrical audio signal 105 in order to generate the output signal 200 in digital form. For this reason, the controller 220 may comprise an analog-to-digital converter (ADC).

In yet one embodiment, the received input electrical audio signal 105 is already in digital form, in which case no ADC is needed. The digital electric audio signal 105 may have been received from an external digital electrical audio signal source, such as from the external entity 250.

However, in one embodiment, the output signal is in analog form. In this embodiment, the control device 220 may further comprise a digital-to-analog converter (DAC) in order to convert any digitally processed data, such as digital electric audio signal 105, into an analog output signal 200.

In one embodiment, the analog input electrical audio signal 105 is first converted into digital data, the data is processed digitally by the controller 220, and then the data is converted back to analog form as analog output signal 200 before outputting the signal 200 to the amplifier 106. The digital processing may comprise adjusting the amplitude of the input signal 105 on the basis of the adjustment model 400, for example.

Figure 6:
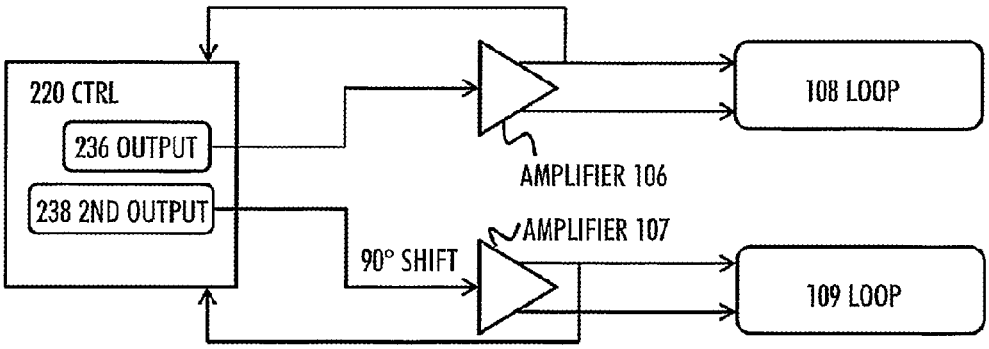
FIG. 6 shows an example of how a phase shift may be used for an induction loop system applying two amplifiers.

In an embodiment, the controller 220 comprises a second output interface 238 for transmitting a second output signal to a second induction loop amplifier 107, as shown in FIGS. 2A and 6. The controller 220 may generate the second output signal on the basis of the received electrical audio signal 105 and, in the same manner as for the (first) output signal 200, adjust the amplitude of the second output signal on the basis of the adjustment model 400 and the detected frequency of the input electrical audio signal 105.

However, for the second output signal, the controller 220 may perform a predetermined phase shift. An example phase shift may be 90 degrees so as to ensure smooth field strength of the electromagnetic field 110. Thereafter, the controller 220 may feed the second, phase shifted output signal to the second induction loop amplifier 107 via the second output interface 238. As shown in FIG. 6, the amplifier 106 may run the induction loop 108 whereas the second amplifier 107 may feed electric current to a second induction loop 109.

In an embodiment, as shown in FIG. 6 for example, each of the induction loop amplifier(s) is a differential amplifier having differential outputs. This is depicted with two outputs leaving the amplifier(s) 106, 107.

In an embodiment, the amplifier 106, 107 is a voltage amplifier, as opposed to being a current amplifier. Therefore, the proposal enables the use of simple voltage amplifiers as the induction loop amplifiers 106, 107. Voltage amplifiers are more robust, than current amplifiers, to different output loads, such as in this case to different induction loops 108. Further, there is a wide variety of voltage amplifiers in the market.

Figure 7A:
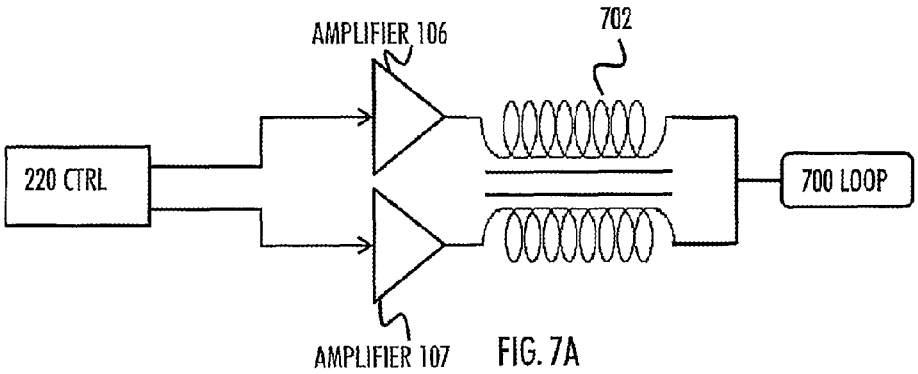
FIGS. 7A and 7B illustrate use of transformers in an induction loop system, according to some embodiments.
Figure 7B:
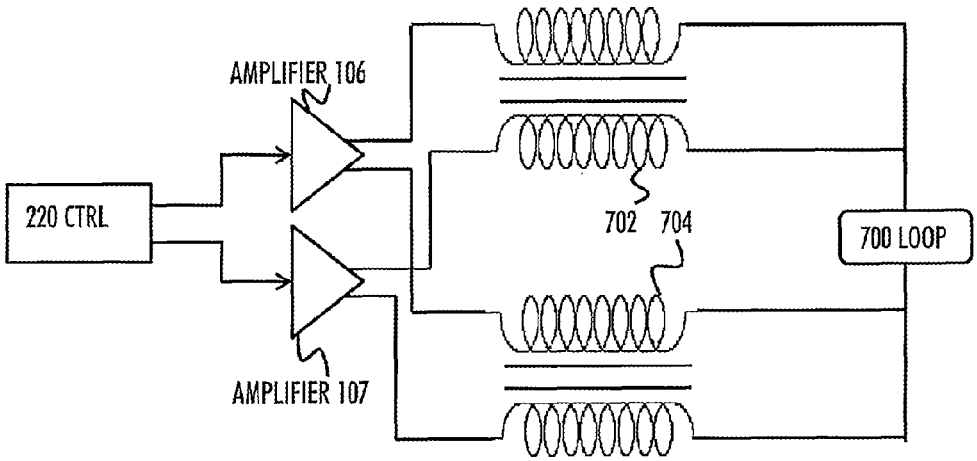

In an embodiment, the amplifiers 106, 107 are connected in parallel and feed electric current to a single common inductive loop 700. This may be beneficial because then the electric current feeding capacity may be increased compared to a case where only one amplifier is feeding one loop. However, when the amplifiers 106, 107 are in parallel connection with each other, as shown in FIGS. 7A and 7B, for example, there is a risk that the amplifiers 106, 107 start competing with each other. In one scenario, due to the gain difference of the amplifiers 106, 107, the other amplifier may start feeding electric current to the other amplifier, which may damage the receiving amplifier. Typically a resistor has been used to avoid such phenomenon. However, the resistor may cause losses in the gain of the amplifiers. Further, use of resistors may cause power losses. Therefore, another solution for enabling the parallel coupling of the amplifiers 106, 107 may be needed.

In an embodiment, as shown in FIG. 7A, the induction loop amplifiers 106, 107 are connected in series with a transformer 702. The use of transformer 702 may be beneficial over the use of resistor due to the fact that transformer 702 may cause smaller gain losses in the system. The power handling capacity of the transformer 702 may be matched according to the gain differences of the amplifiers 106, 107. The used windings of the coils in the transformer 702 and the material of the transformer 702 may be matched according to the applied frequency range (e.g. from 100 Hz to 5 kHz) and the maximum level of electric current used.

As shown in FIG. 7A, the voltage difference at the output of the amplifiers 106, 107, which is due to the gain differences of the amplifier 106, 107, may advantageously be cancelled by connecting the transformer 702 in series with the amplifiers 106, 107. The common loop 700 is then connected in series with the transformer 702.

FIG. 7B depicts an embodiment utilizing a plurality of transformers 702 and 704. Let us denote these as a first and as a second transformer, respectively. Multiple transformers 702, 704 may be needed in case amplifiers 106, 107 are differential amplifiers having differential outputs. Let us denote these outputs as a first and as a second output. In this case, the first outputs of each of the two amplifiers 106, 107 are connected in series with the first transformer 702, whereas the second outputs of the amplifiers 106, 107 are connected in series with the second transformer 704. The common induction loop 700 is then connected in series with the output of the transformers 702, 704. Again, the transformers 702, 704 may be used to cancel the voltage difference at the outputs of the differential amplifiers 106, 107.

It should be noted that the presence of the feedback signal 242 is not depicted in FIGS. 7A and 7B for the sake of clarity of the illustration.

Figure 8:
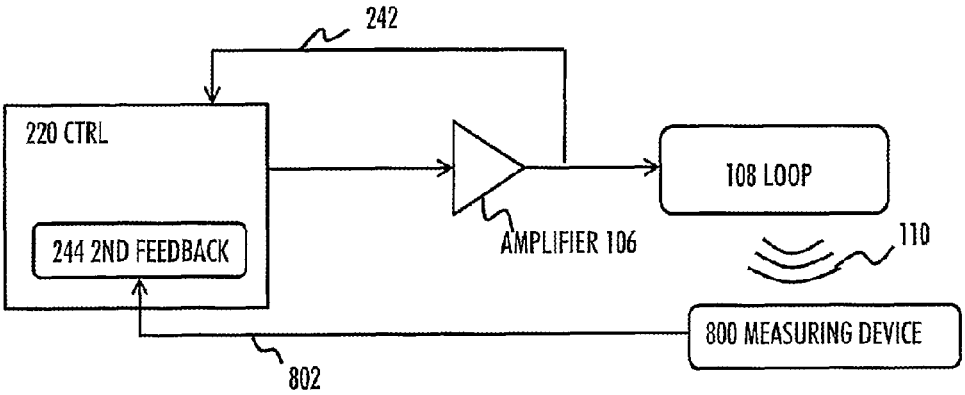
FIG. 8 depicts further adjustment of the adjustment model, according to an embodiment.

Let us then take a look at one embodiment shown in FIG. 8. In this embodiment, the controller 220 may further comprise a second feedback interface 244. This feedback interface 244 may be different than the feedback interface 240. The controller 220 may acquire information indicating the level of induced magnetic field 110 via the second feedback interface 244. The level of induced magnetic field 110 (measured in weber (Wb), Gauss or by indicating the fields strength in Amperes per meter (A/m), for example) may be indicated in a second feedback signal 802. The induced magnetic field 110 may be measured with a measuring device 800, such as a fluxmeter or a field strength meter. The electromagnetic field strength may be measured throughout the whole frequency range, such as over frequencies from 100 Hz to 5 kHz. Such measurement may be done by stepping these frequencies with appropriate density, for example. In an embodiment, the second feedback interface 244 may be a communication interface for receiving e.g. wireless radio frequency communication carrying the information about the intensity of the magnetic flux. The radio frequency communication may utilize wireless local area network (WLAN) or Bluetooth, for example. In another embodiment, the second feedback interface 244 is a coupling which receives a cable from the external magnetic flux measurer 800, such as the fluxmeter.

There may be a plurality of measuring devices 800 in the area so that the intensity of the magnetic field is obtained in different places of the area, such as a room. The controller 220 may, e.g., average the received indication of the magnetic field level so as to obtain an overall level of the magnetic field flux in the area.

As the controller 220 receives the information of the overall magnetic flux field level in the area, the controller 220 may determine the adjustment model 400 further on the basis of the indicated level of induced magnetic field, in addition to the detected electric current level in the loop 108 and the known amplitude and frequency of the calibration signal. This may be beneficial as the metal structures in the area, such as in the room, may change the induced magnetic field, compared to magnetic field generated in an empty space. Different frequencies may experience different type of effect caused by the metal structures in the area. If not taken into account, the frequency response experienced by the listener 114 may vary and affect the listening experience. Owing to the advantageous feature of measuring the induced magnetic field and using this information automatically in the generation of the adjustment model, the generated adjustment model 400 provides a smooth frequency response over the whole breadth of used frequency range. For example, if it is detected that the magnetic flux level is decreased when using audio signals with higher frequencies F, the adjustment model 400 may take this into account by increasing the amplitudes of the output signals 200 when such higher frequency audio signals 105 are present.

Let us look again at FIG. 2A. The controller 220 may further comprise a network communication interface 230 (TRX comprising hardware and/or software for realizing communication connectivity according to one or more communication protocols. The TRX 230 may provide the controller 220 with communication capabilities to access a radio access network, for example. The communication may take place over radio frequencies (e.g. WLAN, Bluetooth, cellular protocols), magnetic fields, infrared, wire (such as via a high definition multimedia interface, HDMI, cable), for example. The existence of such communication capability avails several options, as is explained below.

In an embodiment, upon detecting that a malfunction in the induction loop system 100 of FIG. 2 has occurred, the controller 220 may automatically indicate to a predetermined network destination via the communication interface 230 that the malfunction has occurred. For example, it may be that, for example, the amplifier 106, 107 or the loop 108, 109, 700 is damaged. In such case the frequency response of the induced magnetic field 110 may become uneven or a lack of any magnetic field 110 may be detected. Thus, the malfunction may be detected by analysing the information carried in any of the feedback signals 242, 802, for example. One example is that the feedback signal 802 indicates lack of any magnetic field flux 110, which may be an indication that the loop 108, 109, 700 and/or the amplifier 106, 107 is broken. Another example is that the feedback signal 242 indicates that no current is coming out of the amplifier 106, 107. In such case, it may be determined that the amplifier 106, 107 is broken. In yet one embodiment, it may be detected that the frequency response detected from either of the feedback signals 242, 802 rapidly changes. This may indicate that the loop 108, 109, 700 and/or the amplifier 106, 107 is malfunctioning.

Typically such malfunction may have been noted by the listener 114 and a notice by him/her may be needed before the supervisor noting the problem and before being able to fix the problem and/or taking a secondary hardware into use. However, owing to the advantageous manner of detecting such malfunction and indicating the malfunction automatically, the problematic situation may be noticed and corrected more quickly. The predetermined network destination to which the controller 220 send an indication of the malfunction may be, e.g. the organizer/supervisor of the event where the induction loop system 100 is being used. The controller 220 may be preconfigured with, e.g. IP address of the network destination. The controller 220 may further comprise, e.g. lights, such as light emitting diodes (LEDs), which may blink or burn when any malfunction is detected.

In one embodiment, the controller 220 may periodically transmit notification messages to a predetermined network destination over the communication interface 230. These notification messages may carry an indication of a proper operation of the system. In case the periodic message is not transmitted as planned, the predetermined network destination, such as the supervisor of the induction loop system 100, may immediately detect that something is not correct and take corrective actions. The notification message may also carry information of the detected malfunction, such as that the amplifier 106, 107 seems to be broken. These periodic notification messages may be transmitted automatically by the controller 220.

In yet one embodiment, the communication interface 230 may enable a reception of information, wherein the information is for reconfiguring the controller 220. This enables a remote maintenance and/or re-configuration of the controller 220. For example, the configuration information may cause the controller 220 to apply an additional correction factor for the adjustment model 400, for example. It may be that the supervisor of the area, where the induction loop system 100 is being applied, has noticed that the volume of the output audio signal to the listener 114 is too low, for example. In such case, the supervisor may decide to transmit information to the controller 220 that the amplitude of every frequency is to be increased.

In an embodiment, the controller 220 may generate at least one notification signal having a predetermined frequency. The amplitude of the notification signal may be based on the adjustment model 400. The notification signal may be self-generated and not based on a received input electrical audio signal 105. Examples of notification signals may be announcements to the public, bell rings for indicating e.g. intermediate times, for example.

In an embodiment, the TRX 230 may receive an indication from an external entity 250 according to which the controller 230 needs to generate a specific sound, such as a bell ring. Thus, an external signal source may be utilized for feeding information which the controller 220 may use in the generation of the notification signal. E.g. the controller 220 may itself select the used frequency of the to-be-generated notification signal and select the amplitude from the adjustment model 400 on the basis of the selected frequency.

Then the controller 220 may feed the generated at least one notification signal to the induction loop amplifier 106, 107. The feed may be performed via at least one of the output interfaces 234 and 236.

The control apparatus/device 220 may also comprise a user interface 232 comprising, for example, at least one keypad, a microphone, a touch display, a display, a speaker, etc. The user interface 232 may be used to control the controller 220 by the user.

The processor 222 may comprise a calibration circuitry or module 226 for performing the generation of the adjustment model 400 according to any of the embodiments. An output signal generation circuitry/module 227 may be responsible of generating the output signal 200, according to any of the embodiments. An adjustment circuitry/module 228 may be responsible of performing the adjustment of the output signals 200 before feeding them to the amplifier 106, 107, according to any of the embodiment.

As used in this application, the term 'circuitry' or 'module' refers to all of the following: (a) hardware-only circuit implementations, such as implementations in only analog and/or digital circuitry, and (b) combinations of circuits and software (and/or firmware), such as (as applicable): (i) a combination of processor(s) or (ii) portions of processor(s)/software including digital signal processor(s), software, and memory(ies) that work together to cause an apparatus to perform various functions, and (c) circuits, such as a microprocessor(s) or a portion of a microprocessor(s), that require software or firmware for operation, even if the software or firmware is not physically present. This definition of 'circuitry' applies to all uses of this term in this application. As a further example, as used in this application, the term 'circuitry' would also cover an implementation of merely a processor (or multiple processors) or a portion of a processor and its (or their) accompanying software and/or firmware. The term 'circuitry' would also cover, for example and if applicable to the particular element, a baseband integrated circuit or applications processor integrated circuit for a mobile phone or a similar integrated circuit in a server, a cellular network device, or another network device.

The techniques and methods described herein may be implemented by various means. For example, these techniques may be implemented in hardware (one or more devices), firmware (one or more devices), software (one or more modules), or combinations thereof. For a hardware implementation, the apparatus(es) of embodiments may be implemented within one or more application-specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof. For firmware or software, the implementation can be carried out through modules of at least one chip set (e.g. procedures, functions, and so on) that perform the functions described herein. The software codes may be stored in a memory unit and executed by processors. The memory unit may be implemented within the processor or externally to the processor. In the latter case, it can be communicatively coupled to the processor via various means, as is known in the art. Additionally, the components of the systems described herein may be rearranged and/or complemented by additional components in order to facilitate the achievements of the various aspects, etc., described with regard thereto, and they are not limited to the precise configurations set forth in the given figures, as will be appreciated by one skilled in the art.

Embodiments as described may also be carried out in the form of a computer process defined by a computer program. The computer program may be in source code form, object code form, or in some intermediate form, and it may be stored in some sort of carrier, which may be any entity or device capable of carrying the program. For example, the computer program may be stored on a computer program distribution medium readable by a computer or a processor. The computer program medium may be, for example but not limited to, a record medium, computer memory, read-only memory, electrical carrier signal, telecommunications signal, and software distribution package, for example. Coding of software for carrying out the embodiments as shown and described is well within the scope of a person of ordinary skill in the art.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

The invention claimed is:

1. A control device for an induction loop system, comprising:

an input interface for receiving an input electrical audio signal from an electrical audio signal source;

an output interface for transmitting an output signal to an induction loop amplifier, wherein the induction loop amplifier is configured to feed an induction loop; and at least one processor and at least one memory including a computer program code, wherein the at least one memory and the computer program code are configured, with the at least one processor, to cause the control device at least to:

generate a calibration signal having a known amplitude and frequency;

feed the calibration signal to the induction loop amplifier;

detect level of electric current at the output of the induction loop amplifier; and determine an adjustment model on the basis of the detected level of electric current and the known amplitude and frequency, wherein the adjustment model is for adjusting an amplitude of a to-be-fed output signal based on a frequency of a to-be-received input electrical audio signal such that the level of the electric current at the output of the induction loop amplifier is within predetermined limits.

2. The control device of claim 1, further comprising:

a feedback interface, wherein the at least one memory and the computer program code are configured, with the at least one processor, to cause the control device further to:

detect the level of electric current at the output of the induction loop amplifier by receiving a feedback signal from the output of the induction loop amplifier via the feedback interface.

3. The control device of claim 1, wherein the known frequency of the calibration signal is the maximum frequency of a predetermined frequency range.

4. The control device of claim 1, wherein the at least one memory and the computer program code are configured, with the at least one processor, to cause the control device further to:

generate a plurality of calibration signals, each having a known amplitude and frequency, wherein at least frequencies between different calibration signals are different and within a predetermined frequency range;

feed the calibration signals consecutively to the induction loop amplifier;

for each of the calibration signals, detect the level of electric current at the output of the induction loop amplifier; and determine the adjustment model on the basis of the detected levels of electric current and the known amplitudes and frequencies.

5. The control device of claim 1, wherein the at least one memory and the computer program code are configured, with the at least one processor, to cause the control device further to:

cause a reception of the to-be-received input electrical audio signal;

measure the frequency of the received input electrical audio signal;

generate the to-be-fed output signal on the basis of the received input electrical audio signal;

adjust the amplitude of the output signal on the basis of the adjustment model; and feed the output signal to the induction loop amplifier via the output interface.

6. The control device of claim 1, further comprising:

a second output interface for transmitting a second output signal to a second induction loop amplifier, wherein the at least one memory and the computer program code are configured, with the at least one processor, to cause the control device further to:

feed the output signals to the induction loop amplifiers via the output interfaces, wherein the induction loop amplifiers are connected in series with at least one transformer.

7. The control device of claim 1, further comprising:

a network communication interface for communication of information over a network, wherein the at least one memory and the computer program code are configured, with the at least one processor, to cause the control device further to:

detect whether or not a malfunction of the induction loop system has occurred; and upon detecting that a malfunction has occurred, indicate to a predetermined network destination via the communication interface that a malfunction has occurred.

8. The control device of claim 1, further comprising:

a network communication interface for communication of information over a network, wherein the at least one memory and the computer program code are configured, with the at least one processor, to cause the control device further to:

cause a reception of information, wherein the information is for reconfiguring the control device.

9. The control device of claim 1, further comprising:

a second feedback interface, wherein the at least one memory and the computer program code are configured, with the at least one processor, to cause the control device further to:

acquire information indicating a level of induced magnetic field via the second feedback interface; and determine the adjustment model further on the basis of the indicated level of induced magnetic field.

* * * * *